US009052734B2

(12) United States Patent
Pfromm

(10) Patent No.: US 9,052,734 B2
(45) Date of Patent: Jun. 9, 2015

(54) DEVICE TO SYNCHRONIZE DUAL THROTTLE LEVERS FOR WATERCRAFT

(76) Inventor: Carsten Pfromm, Glen Ellyn, IL (US)

( * ) Notice: Subject to any disclaimer, the term of this patent is extended or adjusted under 35 U.S.C. 154(b) by 353 days.

(21) Appl. No.: 13/407,530

(22) Filed: Feb. 28, 2012

(65) Prior Publication Data

US 2012/0297915 A1 Nov. 29, 2012

Related U.S. Application Data

(60) Provisional application No. 61/447,397, filed on Feb. 28, 2011.

(51) Int. Cl.
*G05G 11/00* (2006.01)
*G05G 9/00* (2006.01)

(52) U.S. Cl.
CPC ..... *G05G 9/00* (2013.01); *Y10T 74/20213* (2015.01)

(58) Field of Classification Search
USPC ..... 74/480 R, 483, 480 B, 556; 292/348, 292/349; 440/87
See application file for complete search history.

(56) References Cited

U.S. PATENT DOCUMENTS

| | | | | |
|---|---|---|---|---|
| 3,729,963 | A * | 5/1973 | Hintz | 70/230 |
| 4,160,499 | A * | 7/1979 | Baba | 477/112 |
| 4,801,282 | A * | 1/1989 | Ogawa et al. | 440/84 |
| 8,612,072 | B2 * | 12/2013 | Garon et al. | 701/21 |

* cited by examiner

*Primary Examiner* — Vicky Johnson
(74) *Attorney, Agent, or Firm* — Joesph A. Fuchs; Nixon Peabody LLP

(57) ABSTRACT

The present invention provides a synchronizing assembly for locking to a dual throttle control assembly having a first control lever and a second control lever, for selectively choosing between independent and simultaneous manipulation of the first and second control levers. The synchronizing assembly has a first housing for releasably connecting to the first control lever, a second housing for releasably connecting to the second control lever and a synchronizing device moveable from a first position to a second position wherein when in the first position the synchronizing device is not connected to the second housing and when in the second position a portion of the synchronizing device is connected to the second housing so that movement of one of the first housing or the second housing moves the other.

9 Claims, 7 Drawing Sheets

DEVICE TO SYNCHRONIZE DUAL THROTTLE LEVERS FOR WATERCRAFT

CROSS-REFERENCE TO RELATED APPLICATION

This application claims priority to U.S. Provisional Patent Application Ser. No. 61/447,397 filed on Feb. 28, 2011 and titled "Device to Synchronize Dual Throttle Levers for Watercraft" which is incorporated herein in its entirety by reference and made a part hereof.

BACKGROUND OF THE INVENTION

1. Technical Field

The present invention relates to an assembly for mounting to dual lever controls such as on a power boat for synchronizing the movement of the lever controls.

2. Background Art

Dual throttle lever assemblies have been used within the industry for controlling watercraft that is equipped with two individual engines such as jet propulsion systems that are independently controllable. Each of the dual throttle assembly levers controls adjusts engine speed and revolutions per minute. Typically, the right lever is used to control the starboard engine, and the left one is for controlling the portside engine.

Prior art dual throttle lever assemblies for some watercraft with jet propulsion are typically operated by pushing each of the throttle levers forward or backward individually to control each of the two engines to maneuver the boat. The farther the lever is moved from a neutral position the greater the speed of the engine up to a maximum displacement of the lever. In another typical use it is desired to shift both levers forward or backward simultaneously in a dynamic motion with the intention to keep both engines at similar RPM-levels. In other words, when one lever is being motioned forward or backward, the other one moves with it.

These and other aspects and attributes of the present invention will be discussed with reference to the following drawings and accompanying specification.

BRIEF DESCRIPTION OF THE INVENTION

The present invention provides a synchronizing assembly for locking to a dual throttle control assembly having a first control lever and a second control lever, the synchronizing assembly for selectively choosing between independent and simultaneous manipulation of the first and second control levers. The synchronizing assembly has a first housing for releasably connecting to the first control lever, a second housing for releasably connecting to the second control lever and a synchronizing device moveable from a first position to a second position wherein when in the first position the synchronizing device is not connected to the second housing and when in the second position a portion of the synchronizing device is connected to the second housing so that movement of one of the first housing or the second housing moves the other.

DETAILED DESCRIPTION OF THE INVENTION

Figure 1:
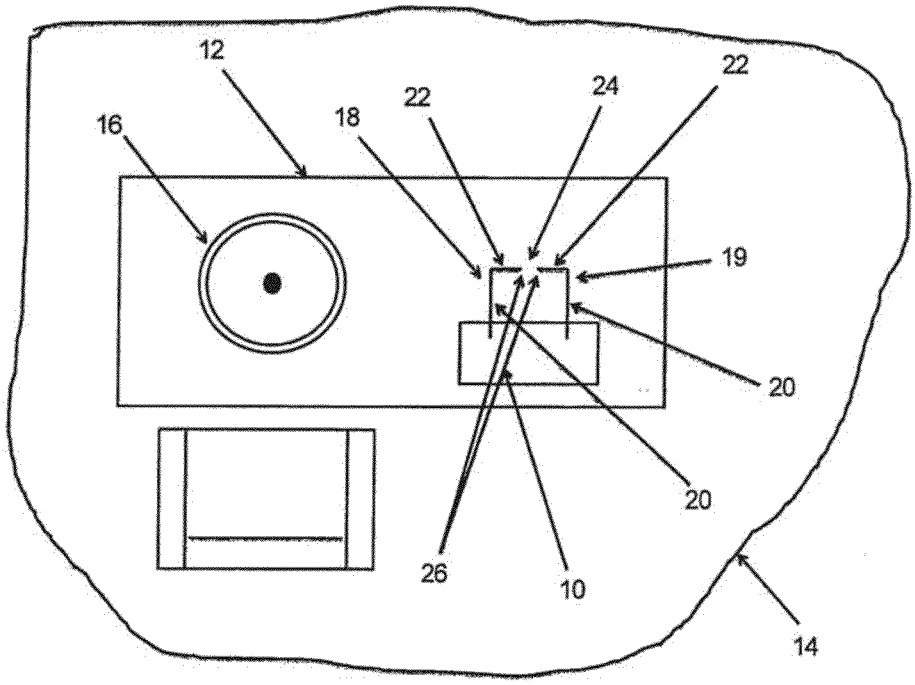
FIG. 1 is a diagrammatic view of a dual throttle control of a power boat.

While this invention is susceptible of embodiment in many different forms, there is shown in the drawings, and will be described herein in detail, specific embodiments thereof with the understanding that the present disclosure is to be considered as an exemplification of the principles of the invention and is not intended to limit the invention to the specific embodiments illustrated.

I will explain my invention with reference to jet boats from the Yamaha Motor Corporation. However, it should be understood this invention can be used for other boat types (jet boats, stern drive boats, etc.) that use two throttle levers. Jet boats that are commercially available from Yamaha Motor Corp. typically have two engines and two throttle levers. Each lever controls one engine individually. This makes it very difficult for the driver to keep both engines synchronized at all speed ranges. The existing and preinstalled lever assembly on Yamaha boats (but also other boat manufactures) does not provide for any means to synchronize both levers and "lock" them so they act as one. This would allow the driver to keep both engines at the same or nearly the same RPM's, which can be desired in many driving situations.

FIG. 1 shows a dual throttle lever assembly 10 mounted in a cockpit 12 of a powerboat 14. Typically, the dual throttle lever assembly 10 is mounted in close proximity to a steering mechanism such as the steering wheel 16 so that a person operating the power boat can control the speed and direction of the boat simultaneously. The dual throttle lever assembly 10 has a first arm 18 and a second arm 19 that independently control the flow of fuel to separate engines and are generally "L" shaped having a first leg 20 and a second leg 22. In a preferred form of the invention, the first arm and second arm, when each arm is in a neutral position, or equally displaced from the neutral position, extend toward the other along the same axis and are generally collinear with a gap 24 separating distal ends 26 of each of the arms. The farther the first and second arms are displaced from a neutral position the higher the flow rate of fuel to their respective engines and the higher the revolutions of the engine and, when in gear, the higher the speed of the boat.

Figure 2:
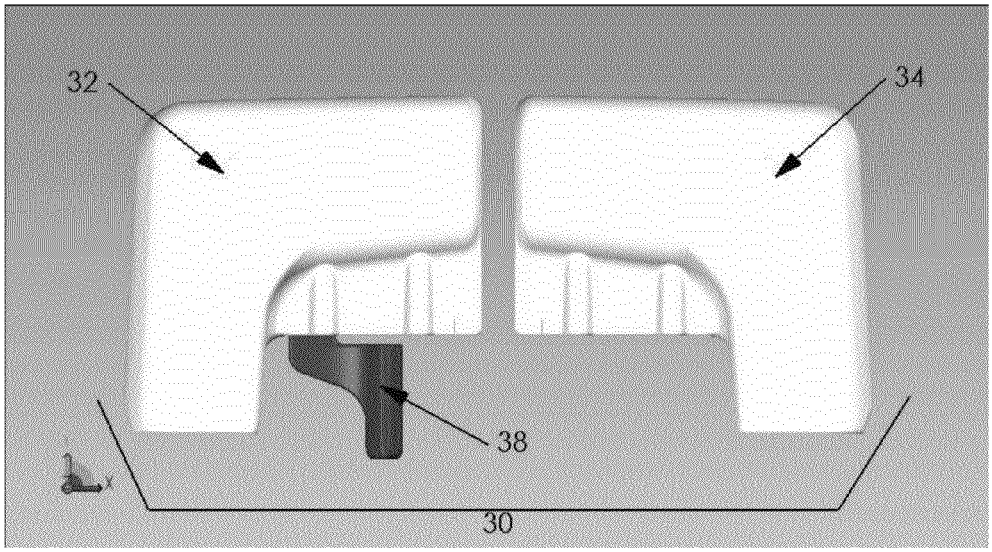
FIG. 2 is a 3D CAD-model side view of the dual throttle synchronizing assembly with a synchronizing pin in an disengaged condition.

FIG. 2 shows a first preferred form of a dual throttle synchronizing assembly 30 for mounting to the dual throttle lever control assembly 10. The synchronizing assembly 30 has two housings 32 and 34 each of which define a generally "L" shaped chamber 36 for receiving arms 18 and 19 respectively. The housings 32 and 34 can be formed as a unitary part or from multiple parts that are, for example, fastened together about the control levers using fasteners, or snap-fit about the control levers or a combination of the two, or any other suitable means known to those of skill in the art. In a preferred form of the invention, the synchronizing assembly 30 is removably attached to the control levers as is shown in FIG. 11.

Figure 3:
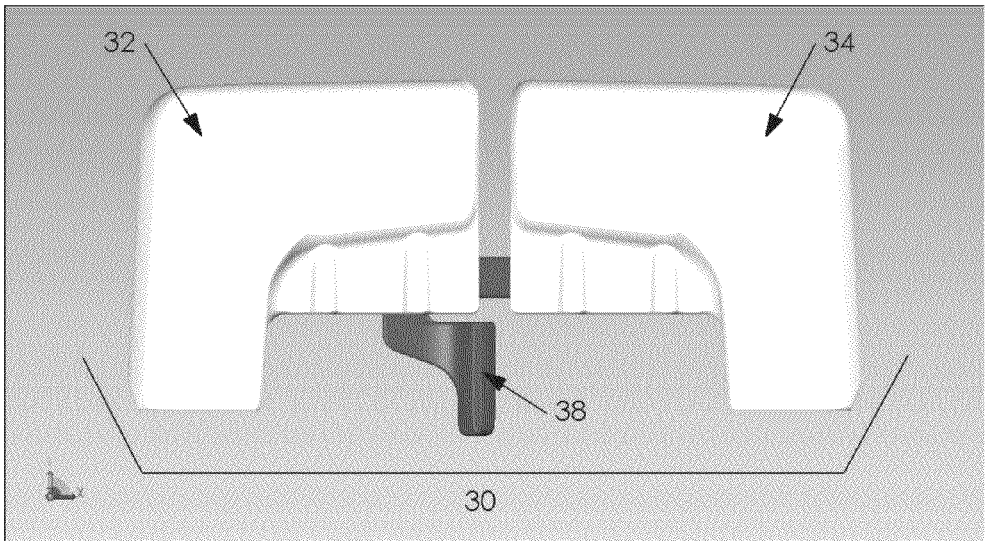
FIG. 3 is a 3D CAD-model side view of the of the dual throttle synchronizing assembly with the synchronizing pin engaged.
Figure 11:
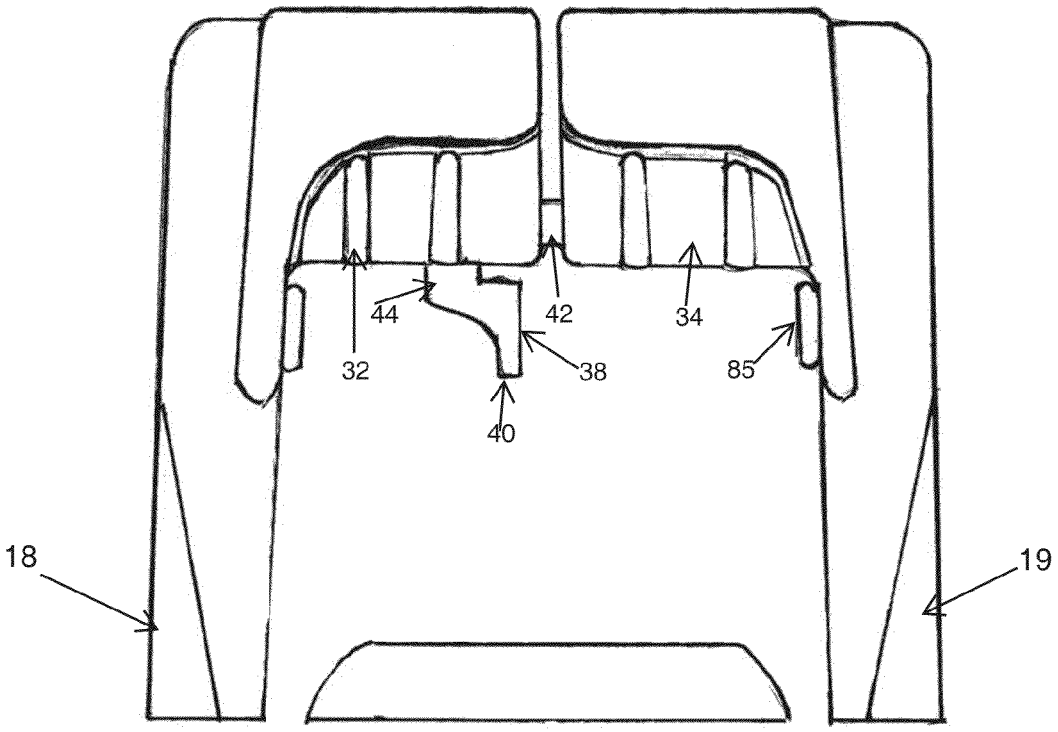
FIG. 11 is a side-elevation view of the first embodiment of the dual throttle synchronizing assembly mounted to the dual throttle lever control assembly and in an engaged condition.

The first housing 32 has a synchronizing pin 38 mounted within the chamber 36 to allow for reciprocating translational movement between a first position where the housings 32 and 34, and their corresponding arms 18 and 19, can be independently operated (FIG. 2), to a second position where the housings and levers are coupled together for dual or simultaneous control (FIGS. 3 and 11).

Figure 6:
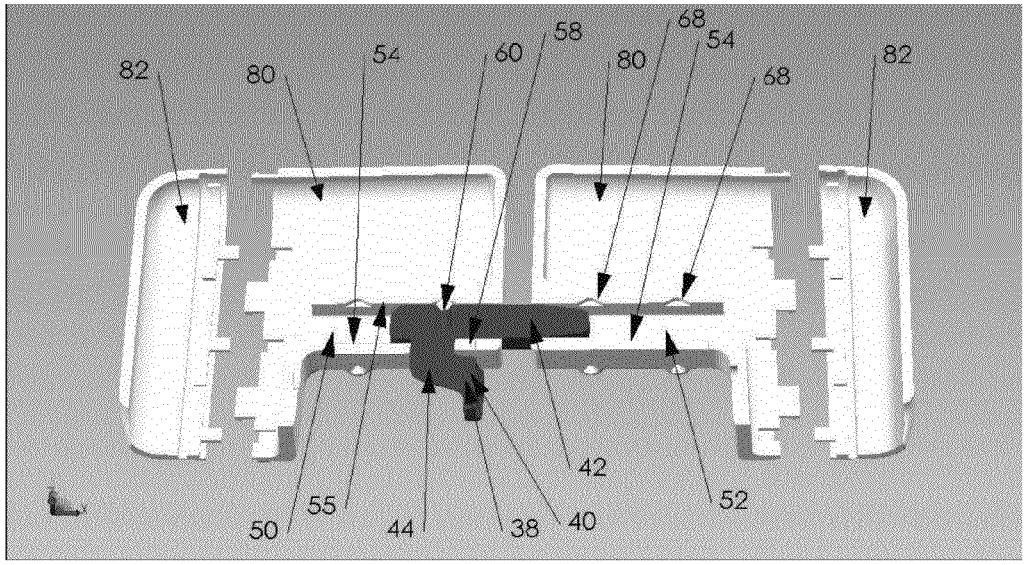
FIG. 6 is a 3D CAD-model of a side elevation view in vertical cross section of the second embodiment of the of the dual throttle synchronizing assembly with the synchronizing pin in an engaged condition.
Figure 8:
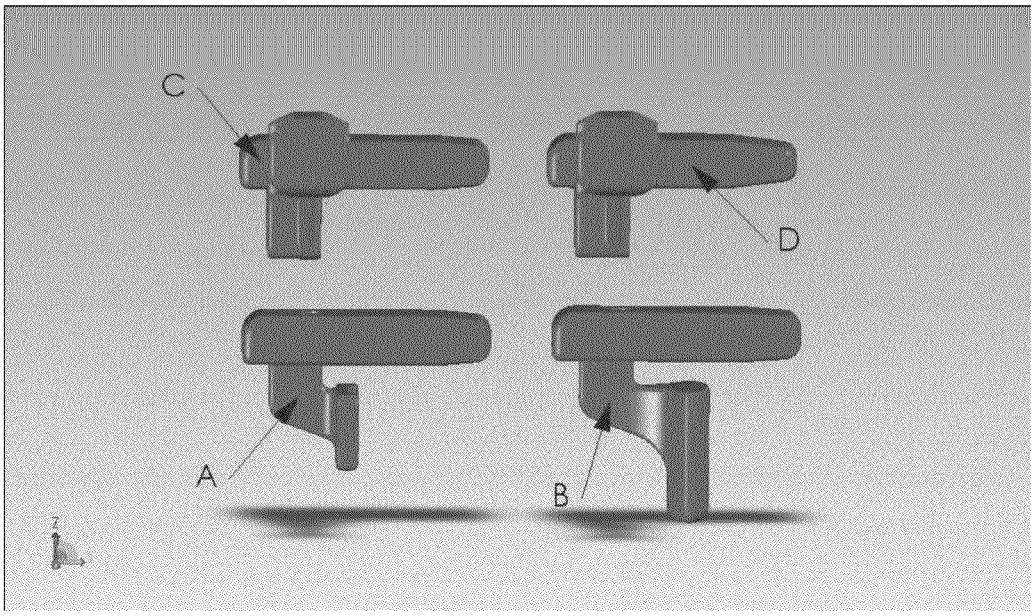
FIGS. 8 and FIG. 9 are 3D CAD-models of a side and isometric view respectively of different embodiments of the synchronizing pin.
Figure 9:
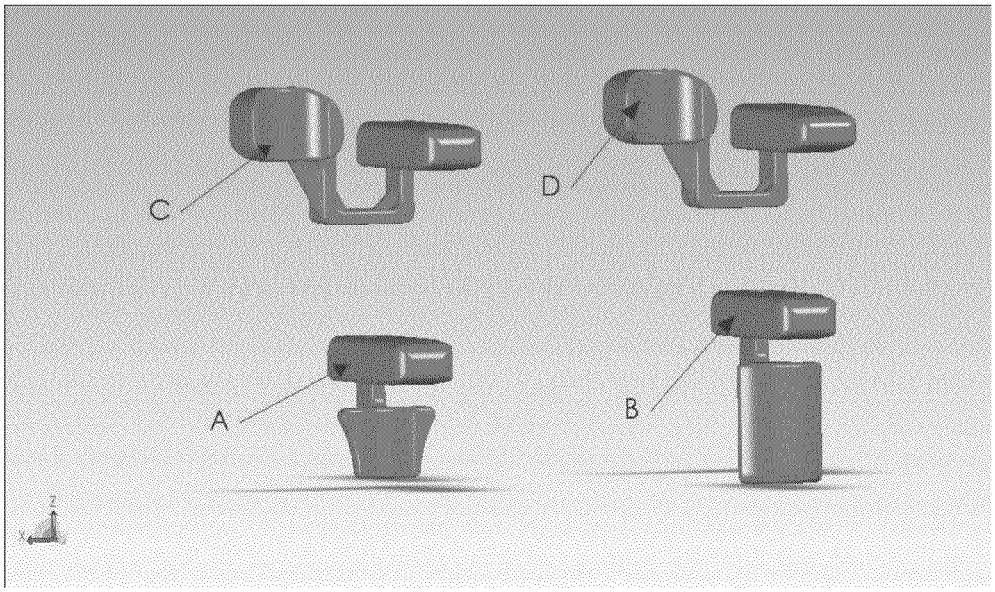

In a preferred form of the invention, the synchronizing pin 38 will have a grasping flange 40, a bolt 42 and a wall 44 connecting the two (See FIGS. 8 and 9). The bolt 42 is mounted in a first slot 50 of the first housing 32 and the grasping flange 40 extends outward from the first housing where it can be manipulated by an operator of the boat. A second slot 52 is positioned in the second housing 34 and is dimensioned to receive a portion of the bolt 42 as shown in FIG. 6 when the synchronizing pin is in the second or locked position. Each of the slots 50, 52 have a bottom wall surface 54, an upper wall surface 55 and a groove 56 through the wall 54. The vertical distance between the bottom and top wall surfaces 54, 55 is slightly greater than the thickness of the bolt 42 to allow for smooth sliding of the synchronizing pin 38. The groove 56 provides a guide that engages a portion of the wall 44 of the synchronizing pin 38. The groove 56 terminates in an end wall 58 that engages the synchronizing pin 38 to prevent it from sliding out from the first housing 32.

In a preferred form of the invention, a steel spring and steel ball assembly 60 is positioned in a bore provided on the bolt 42 (FIG. 6). The ball 60 is biased upward by the spring to engage the top wall surface 55 of the first slot. Detents 68 are provided in the top wall surface 55 at two horizontally spaced locations. The detents are shown to have a generally triangular shape, but other shapes such as round, oval or polygonal; could be used without departing from the scope of the present invention. When the synchronizing pin 38 is in a fully retracted, disengaged condition, the ball 60 is positioned within the first detent and provides resistance from further inadvertent movement of the synchronizing pin that may otherwise occur from, for example, movement of the boat or vibration of the engine, and until acted upon by the operator. Similarly, when in a fully extended, engaged condition, the ball locks into the second detent and provides resistance against further inadvertent movement of the synchronizing pin until acted on by the operator.

Figure 4:
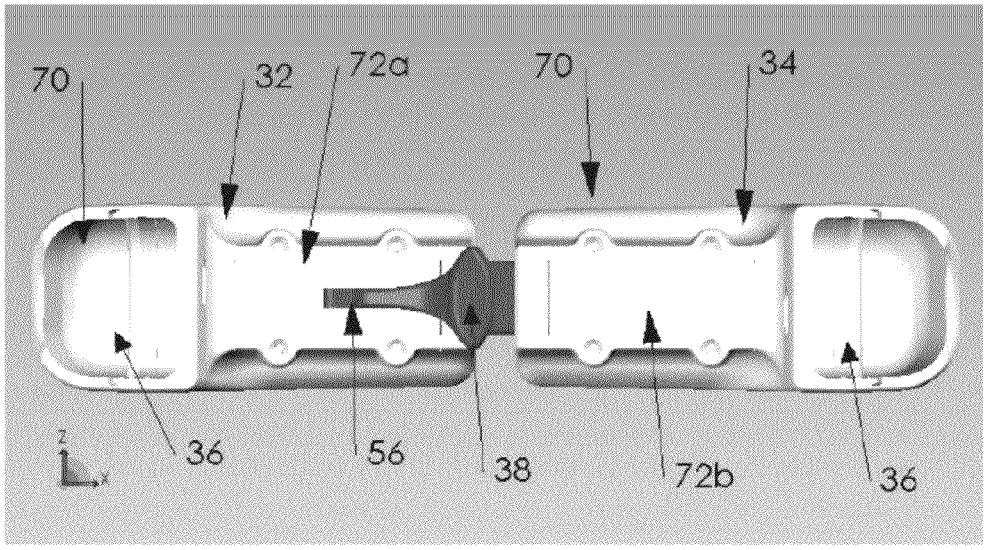
FIG. 4 is a 3D CAD-model bottom view of the of the dual throttle synchronizing assembly with the synchronizing pin in an engaged condition.

FIGS. 2-4 show housings 32 and 34 that are formed from a first portion 70 that defines the "L" shaped chamber and a bottom wall 72 that is removably attached to the first portion 70. The bottom wall 72*a* of housing 32 differs from bottom wall 72*b* as bottom wall 72*a* provides the groove 56. To mount the housing 32 to the left arm 18, the first portion 70 is placed over the arm, the synchronizing pin is positioned in the groove 56 and the bottom wall 72 is attached to the first portion 70 by any suitable means such as snap fitting or by threaded fasteners or the like (FIG. 11).

Figure 5:
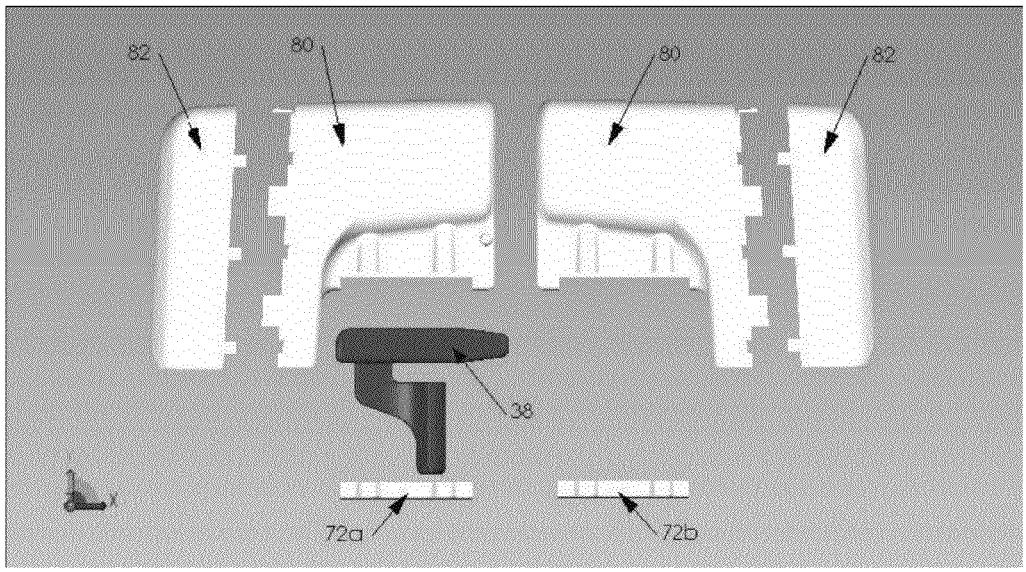
FIG. 5 is a 3D CAD-model side view of a second embodiment of the dual throttle synchronizing assembly of the invention displaying individual components in an unassembled condition.
Figure 7:
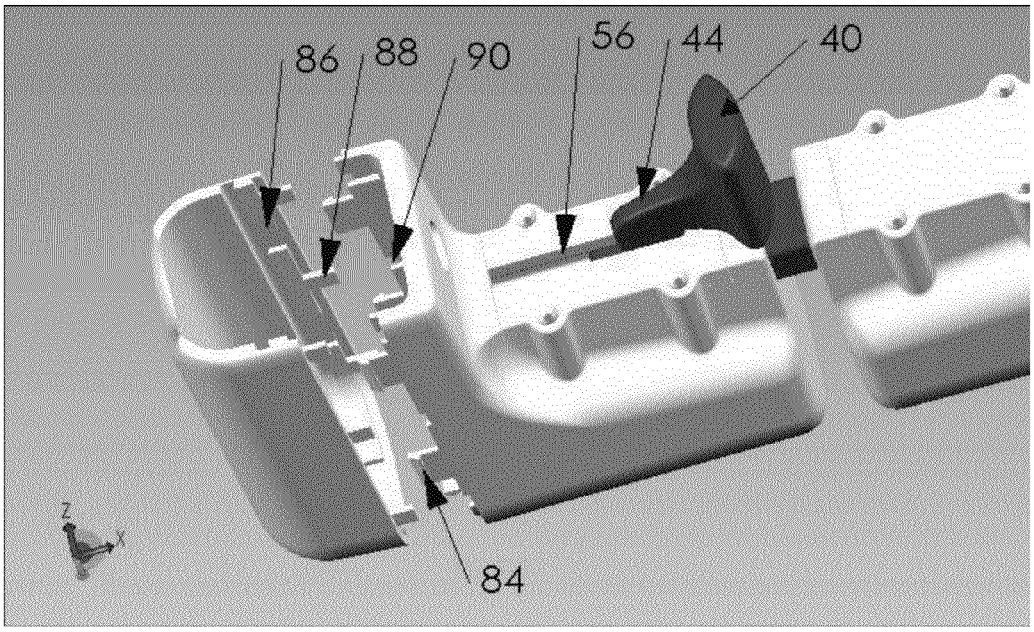
FIG. 7 is a 3D CAD-model of a bottom view of the left housing assembly of the second embodiment of the dual throttle synchronizing assembly in an unassembled condition.

FIGS. 5-7 show a second embodiment where the first and second housings 32, 34 are each formed from mirror-image half assemblies. The two half-assemblies have a main body portion 80 and an end cap portion 82 that are snap fit together. The first half and second half-assemblies are positioned on opposite sides of the control lever to capture the lever and connected together by snap fitting or by threaded fasteners to releasably connect the assembly to the control lever. Of course, when assembling the first housing 32 one must insert the synchronizing pin into position prior to connecting the first half assembly to the second half assembly. Snap features 84 and 86 and alignment fins 88 and 90 are provided in a preferred form of the invention to ensure proper engagement of the parts. It is also contemplated replacing this four piece assembly with an assembly having from two parts to more than four parts.

FIGS. 8 and 9 show preferred forms A,B,C,D of the synchronizing pin. Different pin designs are preferred to allow for a well achieved ergonomic feel to the end user of this invention. Other shapes and design are possible to provide best performance of this invention.

Figure 10:
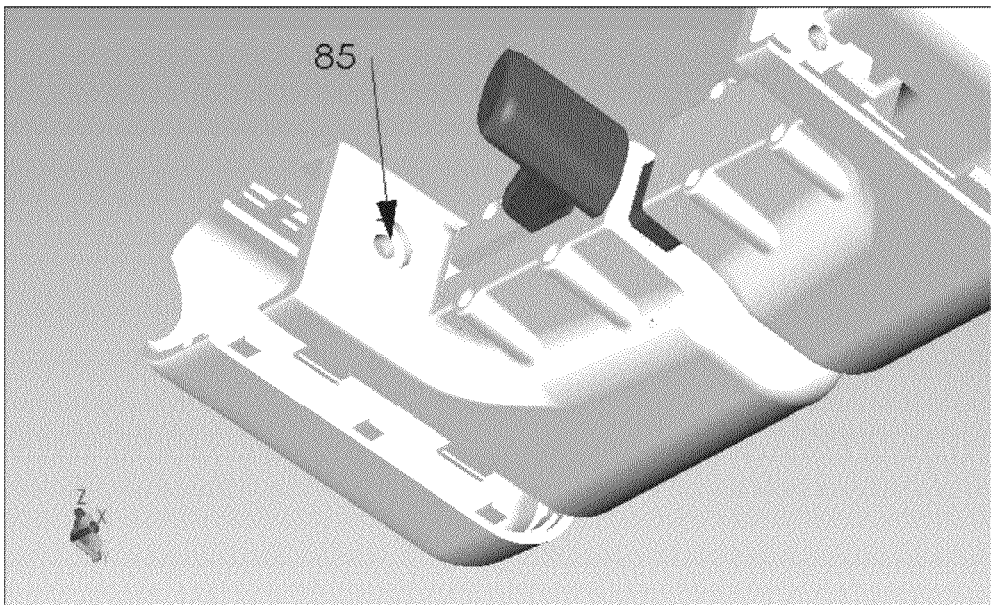
FIG. 10 is a 3D CAD-model of a perspective view of the second embodiment of the dual throttle control with the synchronizing pin in an engaged condition.

FIGS. 10 and 11 show a bore 85 which is positioned through a wall of each of the housings 32 and 34 which accommodates a threaded fastener for threaded engagement to a threaded hole on each of the lever arms 18 and 19 (not shown).

The parts of this invention are generally formed from polymeric materials using techniques such as injection molding. Suitable polymeric materials include polyolefins, polyamides, polyesters, PVC, polycarbonates, ABS, AAS and the like. Suitable polyolefins include homopolymers, copolymers, terpolymers from alpha-olefins having from two to eight carbon atoms. Suitable copolymers include ethylene and propylene with monomers selected from these alpha-olefins, excluding of course those having the same number of carbon atoms.

From the foregoing, it will be observed that numerous variations and modifications may be affected without departing from the spirit and scope of this invention. It is to be understood that no limitation with respect to the specific device illustrated herein is intended or should be inferred.

I claim:

1. A synchronizing assembly for locking to a dual throttle control having first control lever and a second control lever, and for selectively choosing between independent and simultaneous manipulation of the first and second control levers comprising:

a first housing defining a first chamber dimensioned to receive a portion of the first control lever and releasably connect thereto, and having a first slot;

a second housing defining a second chamber dimensioned to receive a portion of the second control lever and releasably connect thereto, and a second slot; and a synchronizing device mounted to the first housing and moveable within the first slot from a first position to a second position, wherein when in the first position the synchronizing device is not connected to the second housing and when in the second position a portion of the synchronizing device is positioned in the second slot to connect the first housing and the second housing so that movement of one of the first housing or the second housing moves the other.

2. The assembly of claim 1 wherein the synchronizing device has a grasping flange and a bolt.

3. The assembly of claim 2 wherein the bolt is positioned in the first slot.

4. The assembly of claim 3 wherein the grasping flange extends outward from the housing for manipulation by a user of the assembly.

5. The assembly of claim 4 wherein the bolt carries a spring and ball assembly and the first slot has a first detent and a second detent spaced from the first detent and when the synchronizing device is in the first position the ball is positioned in the first detent and when in the second position the ball is positioned within the second detent.

6. The assembly of claim 1 wherein the first housing has a main body and an end cap and mating snap assemblies connecting the two together.

7. A synchronizing assembly for locking to a dual throttle control having first control lever and a second control lever, for selectively choosing between independent and simultaneous manipulation of the first and second control levers comprising:

a first housing having a first wall defining a first chamber dimensioned to receive a portion of the first control lever and releasably connect thereto, a first groove is positioned in the first chamber;

a second housing defining a second chamber dimensioned to receive a portion of the second control lever and releasably connect thereto, a second groove is positioned in the second chamber; and a synchronizing device having a grasping flange connected to a bolt, the grasping flange extending through a groove in the first housing and extending outward from the first chamber and beyond the first wall, the bolt being mounted in the first groove for reciprocating translational motion from a first position to a second position in response to movement by a user of the assembly of the grasping flange, wherein when in the first position the synchronizing device is not connected to the second housing and when in the second position a portion of the synchronizing device is positioned in the second groove so that movement of one of the first housing or the second housing moves the other.

8. The assembly of claim 7 wherein the bolt carries a spring and ball assembly and the first slot has a first detent and a second detent spaced from the first detent and when the synchronizing device is in the first position the ball is positioned in the first detent and when in the second position the ball is positioned within the second detent.

9. The assembly of claim 7 wherein the first housing has a main body and an end cap and mating snap assemblies connecting the two together.

* * * * *